US007397006B2

(12) United States Patent
Miyauchi

(10) Patent No.: US 7,397,006 B2
(45) Date of Patent: Jul. 8, 2008

(54) OPERATION MECHANISM FOR ELECTRIC APPARATUS

(75) Inventor: Masao Miyauchi, Miyagi-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 179 days.

(21) Appl. No.: 11/491,448

(22) Filed: Jul. 21, 2006

(65) Prior Publication Data

US 2007/0034489 A1 Feb. 15, 2007

(30) Foreign Application Priority Data

Jul. 26, 2005 (JP) ..... 2005-215761

(51) Int. Cl.
*H01H 15/00* (2006.01)

(52) U.S. Cl. ..... 200/339; 200/5 R; 200/553

(58) Field of Classification Search ..... 200/5 R, 200/5 A, 1 B, 17 R, 341, 553, 556, 329, 339; 29/622

See application file for complete search history.

(56) References Cited

U.S. PATENT DOCUMENTS 5,414,231 A * 5/1995 Sato et al. ..... 200/1 R
5,568,861 A * 10/1996 Lamberti ..... 200/302.3
6,054,655 A * 4/2000 Rudolph et al. ..... 200/16 R
6,191,372 B1 * 2/2001 Sasaki et al. ..... 200/1 R
6,610,945 B2 * 8/2003 Onodera ..... 200/315
6,750,406 B2 * 6/2004 Komatsu et al. ..... 200/1 B
6,911,612 B2 * 6/2005 Seki ..... 200/339
6,914,202 B2 * 7/2005 Sugimoto et al. ..... 200/1 B
7,026,565 B1 * 4/2006 Lee ..... 200/339
7,098,415 B2 * 8/2006 Onodera ..... 200/330
7,291,796 B2 * 11/2007 Liu et al. ..... 200/520

FOREIGN PATENT DOCUMENTS

JP 2630315 4/1997

* cited by examiner

*Primary Examiner*—Michael A Friedhofer
(74) *Attorney, Agent, or Firm*—Brinks Hofer Gilson & Lione

(57) ABSTRACT

The operation mechanism for electric apparatus is provided. An operation mechanism includes a switch element mounted on a circuit board, an upper housing formed with an opening and covering the circuit board, and an operation grip that has an operation shaft hanging therefrom and which is rotatably supported by the upper housing. When the operation grip is oscillatingly operated, the operation shaft drives actuators of the switch element.

5 Claims, 3 Drawing Sheets

OPERATION MECHANISM FOR ELECTRIC APPARATUS

This application claims the benefit of the Japanese Patent Application No. P2005-215761 filed on Jul. 26, 2005, which is hereby incorporated by reference.

BACKGROUND

1. Field

An operation mechanism for a variety of electric apparatuses is provided.

2. Related Art

In a power window apparatus for a vehicle, for example, an operation mechanism which oscillatingly operates an operation grip provided inside a vehicle door to turn on a switch element provided below the operation grip has been widely used. Conventionally, a operation mechanism of this type (see Japanese Patent No. 2630315, for example) has an opening formed on a housing that covers a circuit board mounted with a switch element such that the switch element protrudes from the opening. An operation shaft of an operation grip is inserted into the opening to be engaged with actuators of the switch element, and in which the operation grip is axially and oscillatably supported by the housing near the opening.

The operation shaft protrudes downward from an operation portion of the operation grip, which is provided to cover and close the opening. When the operation portion is oscillatingly operated, the operation shaft is tilted below the opening and drives the actuators of the switch element. A predetermined electrical signal can be output from the switch element in accordance with a tilt direction of the operation shaft. The above configuration has a self-return mechanism in which the switch element causes the actuators to automatically return to an initial position through a return spring. If oscillating operational force applied to the operation portion of the operation grip is removed, the operation shaft in a tilted posture is pressed back to an original position due to resilience of the return spring.

In assembling the conventional operation mechanism configured as summarized above, the circuit board mounted with the switch element is positioned and installed in a pair of the upper housing and a lower housing. The operation shaft of the operation grip is inserted from above into the opening formed on the upper housing, and a leading end portion of the operation shaft is engaged with the actuators of the switch element. A rotation fulcrum of the operation grip is snap-joined to the upper housing. Thereby, the operation grip is axially supported by the housing.

In installing the operation grip to the housing in the operation mechanism of this type, when the operation shaft of the operation grip has been inserted into the opening of the housing by a predetermined length, the operation shaft needs to be accurately located at an engagement position with the actuators of the switch element (i.e., an electric component).

When the inserting operation of the operation shaft is started, the inside of the opening formed on the housing cannot be visually observed as being interrupted by the operation portion of the operation grip. A special positioning jig is required for accurately positioning the operation shaft with respect to the actuators. As a result, an assembler has to perform a complicated operation of installing the operation grip while using the positioning jig. Such operation also requires skill, and thus the installing operation of the operation grip forms a factor deteriorating the work efficiency of the assembly operation of the entire operation mechanism.

When a plurality of the operation grips are provided in a line, as in the case of the operation mechanism used in such apparatuses as the power window apparatus for a vehicle, the installing operation of the operation grip using the positioning jig needs to be performed more than once. Therefore, the work efficiency of the assembly operation is substantially deteriorated.

SUMMARY

An operation mechanism for electric apparatus includes actuators, an electric component, a circuit board, a housing, and an operation grip. The electric component includes a return spring that causes the actuators to automatically return to an initial position. The circuit board is mounted with the electric component. The housing covers the circuit board and includes an opening formed at a position facing the actuators. The operation grip includes an operation shaft that is inserted into the opening to be engaged with the actuators, and which has an engaging portion at a leading end portion thereof. The operation grip is movably operated with respect to the housing to cause the operation shaft to drive the actuators.

A guide portion is engageable with and disengageable from the engaging portion that is provided to a region of inner walls of the housing or to a chassis portion of the electric component. In an assembly process of installing the operation grip to the housing, the operation shaft inserted into the opening is guided into the housing through engagement between the engaging portion and the guide portion. The engaging portion is separate from the guide portion when the operation shaft has been inserted into the opening by a predetermined length.

In the configured operation mechanism for electric apparatus, when the operation grip is installed by inserting the operation shaft into the opening formed on the housing, the operation grip is pressed downward with the engaging portion of the operation shaft being engaged with the previously provided guide portion. The operation shaft is automatically guided to a predetermined position by the guide portion.

The operation shaft can be accurately positioned with respect to the actuators of the electric component, even if the inside of the opening cannot be visually observed. Displacement of position between the operation shaft and the actuators can be prevented. Therefore, the installing operation of the operation grip to the housing can be securely performed.

In the present embodiment the use of the positioning jig and the skill of the assembler are not required, and the operation grip can be easily and accurately installed. The work efficiency of the assembly operation is substantially improved. When the operation grip is installed to the housing, the engaging portion of the operation shaft is separate from the guide portion. The guide portion does not interrupt the movement of the operation grip which has been installed to the housing.

In the operation mechanism of the above configuration, the guide portion may preferably include a guide groove or a guide rail extending along a direction in which the operation shaft is inserted in the installing operation of the operation grip. With this configuration, the operation shaft can be securely guided to the predetermined position without complicating the configuration of the guide portion or the engaging portion.

Further, in the operation mechanism of the above configuration, the operation shaft may be engaged with the actuators before the engaging portion of the operation shaft is separated from the guide portion. With this configuration, when the engaging portion has been separated from the guide portion, the engagement between the operation shaft and the actuators is secured. Therefore, the above configuration is preferable in that an effect of preventing defective installing of the operation grip is increased.

Further, in the operation mechanism of the above configuration, the operation grip may be rotatably supported by the housing to be oscillatingly operated, and the electric component may be a switch element. With this configuration, the actuators of the switch element are driven by the operation shaft which is tilted in accordance with the oscillating operation of the operation grip. Therefore, the switching operation mechanism, which suppresses an increase in size of an area wherein the operation grip can move and thus which is preferable for reduction in size, can be obtained. Alternatively, the operation mechanism may be configured such that the operation grip is supported by the housing to be slidingly moved, for example, a sliding operation of the operation grip can be performed. Further, the electric component is not limited to the switch element and may be a variable resistor.

Further, in the operation mechanism of the above configuration, one pair of the guide portions may be formed on opposite regions of the inner walls of the housing. With this configuration, in the installing operation of the operation grip, the operation shaft inserted into the opening formed on the housing can be securely prevented from being displaced in position. Further, the above configuration is preferable in that the provision of the guide portions to the inner walls of the housing has little influence on component cost.

DRAWINGS

DESCRIPTION

Figure 1:
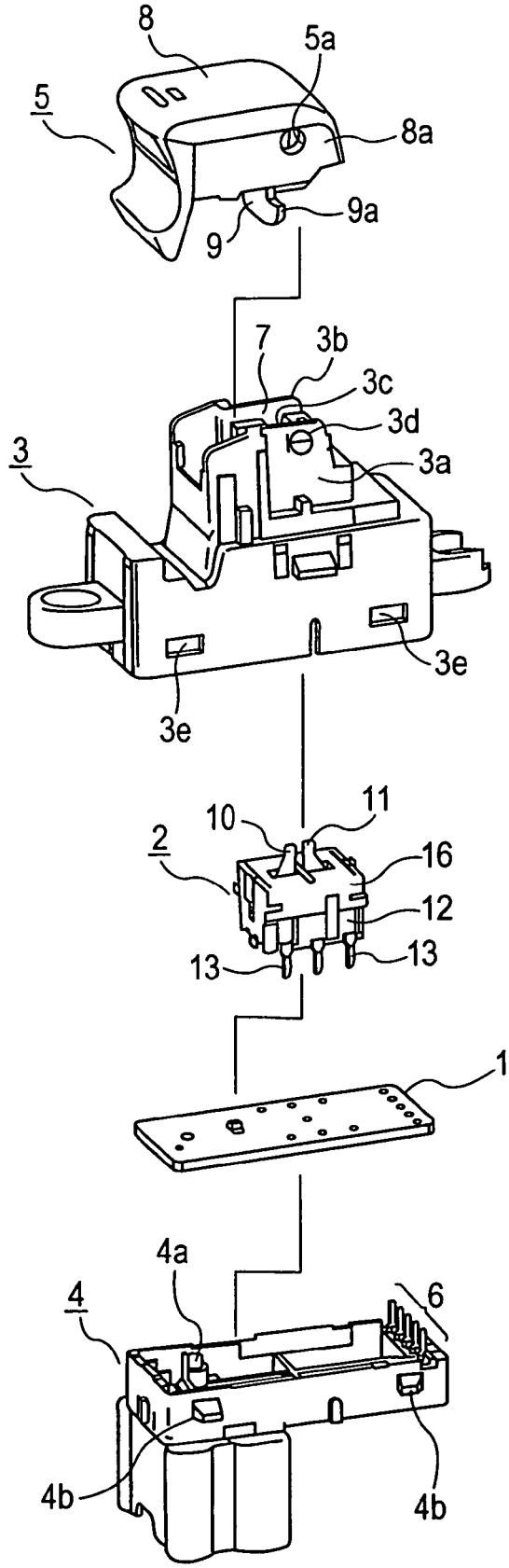
FIG. 1 is an exploded perspective view of a switching operation mechanism.
Figure 2:
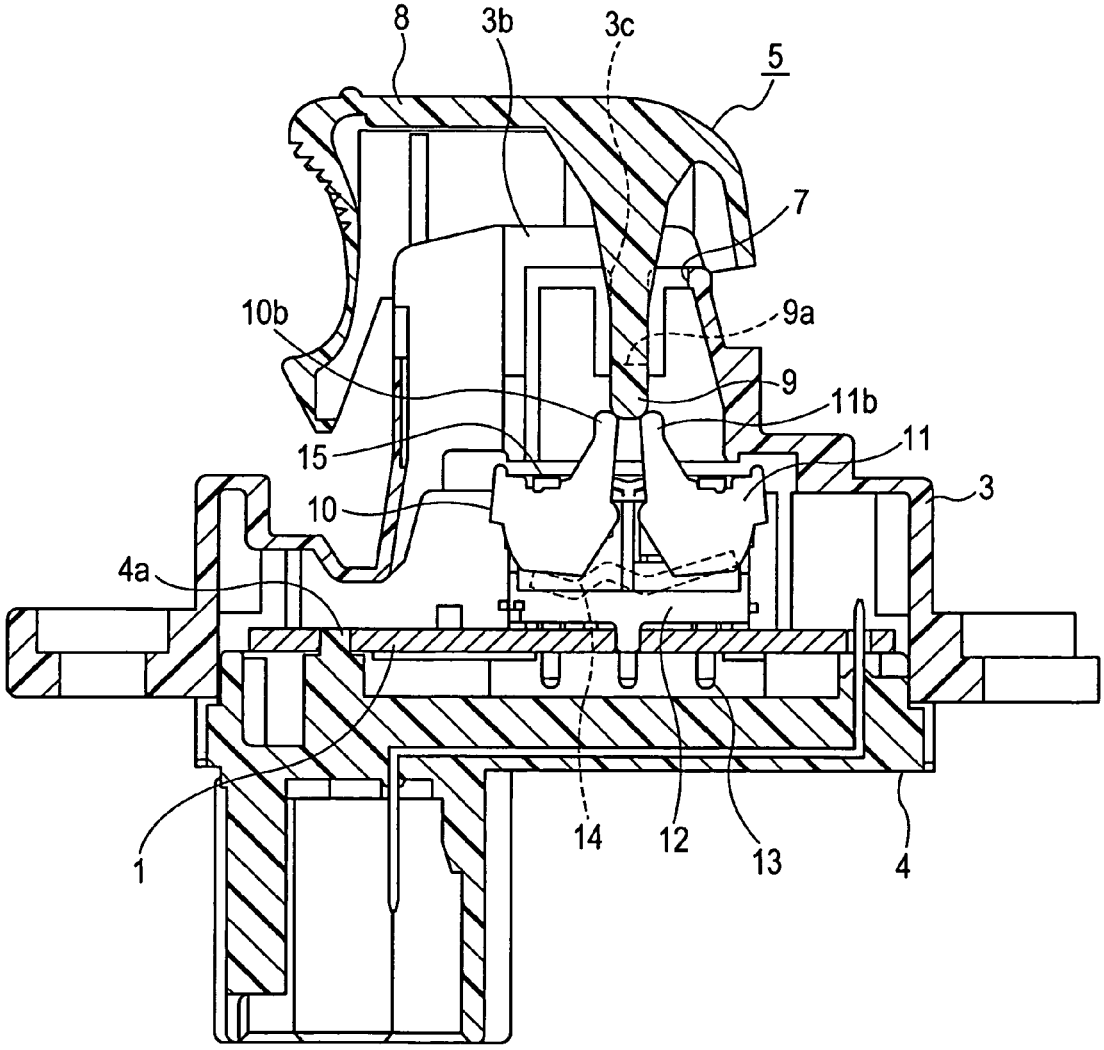
FIG. 2 is a vertical cross-sectional view of the operation mechanism in an assembly process of an operation grip.
Figure 3:
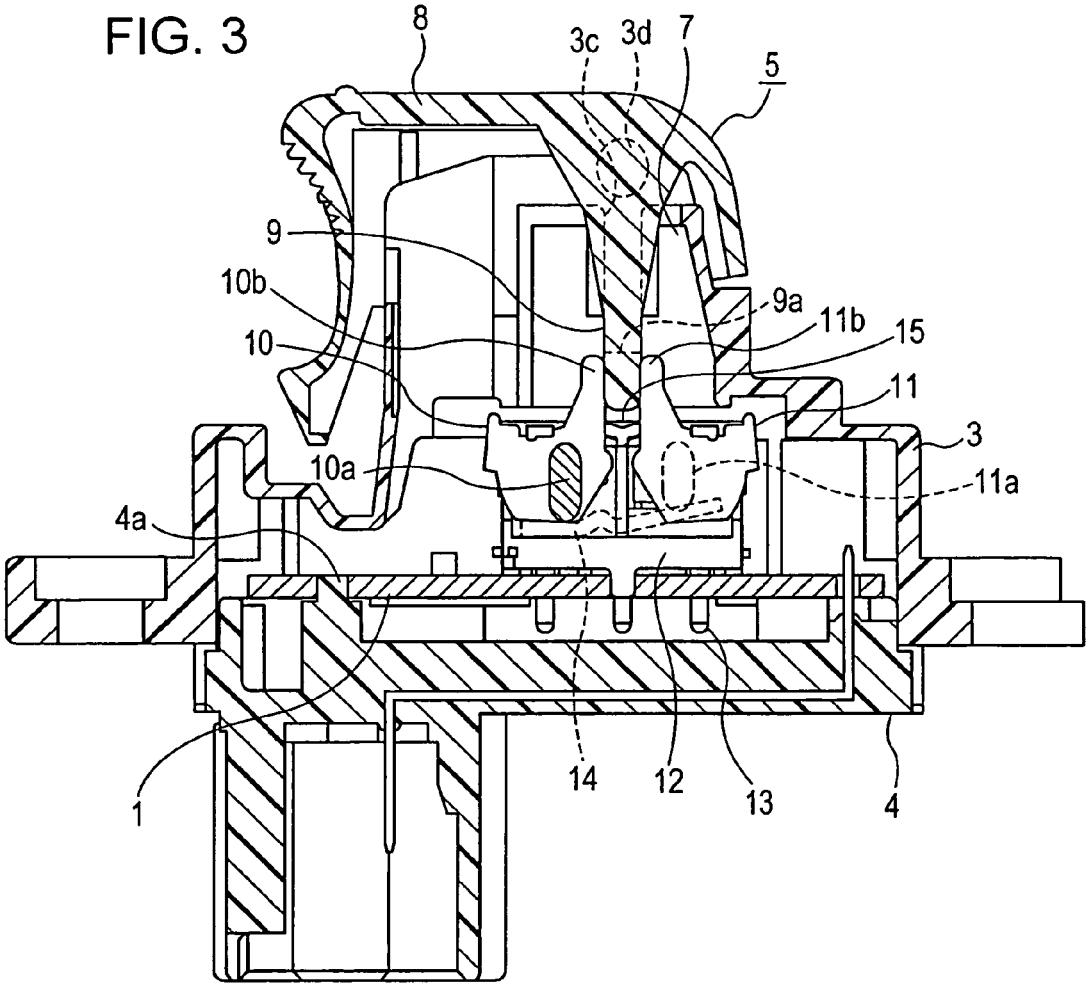
FIG. 3 is a vertical cross-sectional view of the operation mechanism after the assembly process.

A switching operation mechanism illustrated in FIGS. 1 to 3 is used as an operation switch of a power window apparatus for vehicle, for example. The switching operation mechanism mainly includes a switch element (i.e., an electric component) 2 which is mounted on a circuit board 1. An upper housing 3 and a lower housing 4 are integrated with each other to form an outer shell. An operation grip installed to the upper housing 3, and external connecting terminals 6 are fixed to one side of the lower housing 4. The circuit board 1 mounted with the switch element 2 is placed in an internal space in the outer shell formed by the upper housing 3 and the lower housing 4.

The circuit board 1 is electrically connected to an external circuit (not illustrated) via the external connecting terminals 6. The upper housing 3 that covers the circuit board 1 is formed with an opening 7 at a position facing an upper surface of the switch element 2. The opening 7 is defined by inner wall surfaces of walls 3*a* and 3*b*, and guide grooves 3*c* (the guide groove 3*c* formed on the wall 3*a* is not illustrated) are formed on opposite regions of the inner wall surfaces of walls 3*a* and 3*b* to linearly extend in vertical directions. The operation grip 5 is a molded product in which an operation portion 8 is integrated with an operation shaft 9. The operation portion 8 is provided to cover and close the opening 7, and the operation shaft 9 hangs down from the operation portion 8.

Shaft holes 5*a* are formed by drilling on a pair of side walls 8*a* of the operation portion 8, and spindles 3*d* (the spindle 3*d* provided on the wall 3*b* is not illustrated) are provided to project from the walls 3*a* and 3*b* of the upper housing 3. When the spindles 3*d* are snapped into the corresponding shaft holes 5*a*, the operation grip 5 is rotatably supported by the upper housing 3 such that an oscillating operation of the operation grip 5 can be performed.

As illustrated in FIG. 1, in the vicinity of a leading end of the operation shaft 9 of the operation grip 5, an increased width portion 9*a* (i.e., an engaging portion) is formed. The increased width portion 9*a* is increased in width and has a leading end which is formed into a cylinder shape to form a taper surface. The size of the increased width portion 9*a* in a width direction is set to be approximately the same as the distance between the pair of the guide grooves 3*c* which face each other. The operation shaft 9 of the operation grip 5 is provided on the switch element 2 in the internal space covered by the upper housing 3.

As illustrated in FIG. 3, when the operation shaft 9 is not operated, a central portion of the leading end of the operation shaft 9 is nipped between a pair of actuators 10 and 11 of the switch element 2, and opposite ends in the width direction of the increased width portion 9*a* are respectively located directly under the pair of the guide grooves 3*c*. The opposite ends in the width direction of the increased width portion 9*a* are inserted and slidingly moved in the pair of the guide grooves 3*c* in an installing operation of the operation grip 5. The operation shaft 9 is guided into a space formed by flat surfaces including the two guide grooves 3*c*. Therefore, positions at which the two guide grooves 3*c* are formed are determined such that the operation shaft 9 is located between the actuators 10 and 11.

In the switch element 2, a case 12 formed by a chassis is provided with fixed contact members 13 which are soldered to a wiring pattern of the circuit board 1. The case 12 accommodates therein the actuators 10 and 11, a conductive plate 14, another conductive plate (not illustrated), and a blade spring member 15. The actuator 10 includes a sliding portion 10*a* and a pressed portion 10*b*. A leading end of the actuator 10 is formed into a cylinder shape to form a taper surface. The actuator 11 includes a sliding portion 11*a* and a pressed portion 11*b*. The conductive plate 14 is oscillatable and receives the sliding portion 10*a* of the actuator 10, and the another conductive plate is oscillatable and receives the sliding portion 11*a* of the actuator 11.

The blade spring member 15 functions as a return spring for the actuators 10 and 11, which resiliently biases the sliding portions 10a and 11*a* downward. An upper end portion of the case 12 is provided with a cover member 16 formed by a metal plate. The pressed portions 10*b* and 11*b* of the actuators 10 and 11 face each other in a standing posture and protrude upward from the cover member 16. The central portion at the leading end of the operation shaft 9 of the operation grip is located between the pressed portions 10*b* and 11*b*. In the switch element 2, when the conductive plate 14 (or the another conductive plate not illustrated) oscillates and changes its posture in the case 12, the conductive plate 14 (or the another conductive plate not illustrated) contacts or separates from a predetermined one of the fixed contact members 13. Thereby, a variety of electrical signals are output.

The circuit board 1 is positioned by a positioning pin 4*a* of the lower housing 4. Further, the upper housing 3 and the lower housing 4 are positioned and integrated with each other. Therefore, relative positions between the switch element 2 mounted at a predetermined position on the circuit board 1 and the guide grooves 3*c* of the upper housing 3 are regulated with high accuracy.

In assembling the switching operation mechanism, the circuit board 1 mounted with the switch element 2 is first installed in the lower housing 4. Snap claws 4*b* formed on side surfaces of the lower housing 4 are snapped into latch holes 3*e* formed on side surfaces of the upper housing 3. Thereby, the two housings,for example, the upper housing 3 and the lower housing 4 are integrated with each other. The opening 7 formed on the upper housing 3 that covers the circuit board 1 is located directly above the switch element 2.

During the next process of installing the operation grip 5, the operation shaft 9 is inserted from above into the opening 7 by a predetermined length. The operation shaft 9 is inserted with pressure into a space between the pressed portions 10*b* and 11*b* of the actuators 10 and 11, and the spindles 3*d* of the upper housing 3 are snapped into the shaft holes 5*a* of the operation grip 5.

The installing operation of the operation grip 5 will now be described in detail. In starting the inserting operation of the operation shaft 9 into the opening 7, the increased width portion 9*a* formed to the vicinity of the leading end of the operation shaft 9 is first positioned with respect to the pair of the guide grooves 3*c* formed on the inner walls of the upper housing 3, and the increased width portion 9*a* is engaged with the pair of the guide grooves 3*c*. The guide grooves 3*c* extend to positions near an upper end of the opening 7. Thus, an assembler can easily perform the engaging operation between the increased width portion 9*a* and the guide grooves 3*c* while checking with eyes.

The operation grip 5 is pressed downward after the increased width portion 9*a* has been engaged with the pair of the guide grooves 3*c*. The increased width portion 9*a* is guided by the two guide grooves 3*c* to descend directly downward. Therefore, the operation grip 5 moves directly downward, without being tilted. When the operation shaft 9 has been inserted into the opening 7 by a certain length, as illustrated in FIG. 2, the leading end of the operation shaft 9 reaches the space between the pressed portions 10*b* and 11*b* of the actuators 10 and 11. The operation grip 5 is further pressed downward, and the operation shaft 9 is inserted into the opening 7 by a predetermined length.

As illustrated in FIG. 3, the increased width portion 9*a* is separated from the guide grooves 3*c*, and the leading end of the operation shaft 9 can be inserted deep into the space between the pressed portions 10*b* and 11*b*. The spindles 3*d* can be snapped into the shaft holes 5*a* so that the operation grip 5 is axially supported by the upper housing 3. Thereby, the installing operation of the operation grip 5 is completed.

The actuators 10 and 11 of the switch element 2 are applied with resilient force of the blade spring member 15. Therefore, in the transition from the state illustrated in FIG. 2 to the state illustrated in FIG. 3, the operation shaft 9 is inserted with pressure into the space between the pressed portions 10*b* and 11*b* while causing the pressed portions 10*b* and 11*b* to move against the resilient force. When the installing operation has been completed, the operation shaft 9 is resiliently nipped by the pressed portions 10*b* and 11*b* such that a rattling does not occur.

As described above, the relative positions between the switch element 2 and the guide grooves 3*c* of the upper housing 3 are regulated with high accuracy. Relative positions between the actuators 10 and 11 and the guide grooves 3*c* are regulated with high accuracy. Therefore, even if there is some degree of variation in positional accuracy, the increased width portion 9*a* can be securely engaged with the actuators 10 and 11, since the taper surface is formed to the leading end of the increased width portion 9*a* and to the leading end of each of the actuators 10 and 11 in consideration of such variation in positional accuracy.

In the present embodiment, the taper surface is formed both to the increased width portion 9*a* and to each of the actuators 10 and 11. The taper surface of either one of the increased width portion 9*a* and each of the actuators 10 and 11 can be reduced in size. The taper surface may be formed to only either one of the increased width portion 9*a* and each of the actuators 10 and 11 in consideration of the variation in positional accuracy. In the present embodiment, the circuit boars 1 is positioned with respect to the lower housing 4, and the lower housing 4 is positioned with respect to the upper housing 3 formed with the guide grooves 3*c*. The circuit board 1 may be positioned with respect to the upper housing 3 formed with the guide grooves 3*c*.

Operations of the configured switching operation mechanism will now be briefly described. In a non-operation state illustrated in FIG. 3, if the oscillating operation of the operation grip 5 is performed to rotate the operation grip 5 around the spindles 3*d* in a clockwise direction in the drawing, for example, the operation shaft 9 is tilted, and the leading end portion of the operation shaft 9 moves to the left in the drawing. The pressed portion 10*b* is pressed by the operation shaft 9 and is tilted to the left in the drawing. The sliding portion 10*a* of the actuator 10 slidingly moves obliquely upward along an inclined surface of the conductive plate 14. As a result, the blade spring member 15 is pressed and bent by the actuator 10.

When the sliding portion 10*a* has passed an oscillating fulcrum of the conductive plate 14, the conductive plate 14 is driven to rotate and changes its posture in the case 12. A conduction state between the conductive plate 14 and the fixed contact members 13 is changed, and a predetermined electrical signal is output. If oscillating operational force is applied to the operation grip 5 is removed in the above state, the blade spring member 15 presses the actuator 10 back, and the sliding portion 10*a* slidingly moves on the conductive plate 14 in a reverse direction. The conductive plate 14 is driven to rotate in a reverse direction and returns to the previous posture illustrated in FIG. 3. The operation shaft 9 in the tilted posture is biased by the blade spring member 15 via the pressed portion 10*b* and is pressed back to the previous position illustrated in FIG. 3.

If the oscillation operation of the operation grip 5 is performed to rotate the operation grip 5 in a counterclockwise direction in FIG. 3, the leading end portion of the operation shaft 9 presses the pressed portion 11*b*. Thus, the sliding portion 11*a* of the actuator 11 slidingly moves on the another conductive plate (not illustrated). The movement of the sliding portion 11*a* is basically the same as the movement described above, and thus description thereof will be omitted.

As described above, in the switching operation mechanism according to the present embodiment, the actuator 10 and 11 of the switch element 2 are driven by the operation shaft 9 which is tilted in accordance with the oscillating operation of the operation grip 5. The switching operation mechanism is preferable for reduction in size, suppressing an increase in size of an area in which the operation grip 5 can move. During the process of assembling the switch operation mechanism, when the operation grip 5 is installed by inserting the operation shaft 9 into the opening 7 formed on the upper housing 3, the operation grip 5 is pressed downward with the increased width portion 9*a* of the operation shaft 9 being engaged with the guide grooves 3*c* which have been previously formed on the upper housing 3.

The operation shaft 9 is automatically guided to the predetermined position by the guide grooves 3*c*. Even if the inside of the opening 7 cannot be visually observed, the operation shaft 9 can be accurately positioned with respect to the actuators 10 and 11 of the switch element 2, and the displacement in position between the operation shaft 9 and the actuators 10 and 11 can be prevented. A snap-joining between the operation grip 5 and the upper housing 3 can be securely performed. Accordingly, the use of a positioning jig and the skill of the assembler are not required, and the operation grip 5 can be easily and accurately installed. Accordingly, the work efficiency of the assembly operation is substantially improved.

When the operation grip 5 is snap-joined to the upper housing 3, the increased width portion 9*a* of the operation shaft 9 has been completely separate from the guide grooves 3*c*. Therefore, there is no possibility that the guide grooves 3*c* interrupt the movement of the installed operation grip 5.

As illustrated in FIG. 2, the present embodiment is configured such that, in the installing operation of the operation grip 5, the leading end of the operation shaft 9 is engaged with the actuators 10 and 11 of the switch element 2 before the increased width portion 9*a* is separated from the guide grooves 3*c*. When the increased width portion 9*a* has been separated from the guide grooves 3*c*, the engagement between the operation shaft 9 and the actuators 10 and 11 is ensured. Accordingly, an effect of preventing defective installing of the operation grip 5 is increased. The present embodiment may be modified such that the operation shaft 9 is engaged with the actuators 10 and 11 immediately after the increased width portion 9*a* has been separated from the guide grooves 3*c*.

The actuators 10 and 11 may be formed such that the distance between the actuators 10 and 11 is increased at the upper ends thereof, and that the increased width portion 9*a* is located in the space defined by the increased distance when the increased width portion 9*a* has been separated from the guide grooves 3*c*. For example, the increased width portion 9*a* should be guided so as to be located at the predetermined position after the installing operation, at which the increased width portion 9*a* is engaged with the actuators 10 and 11 and is separated from the guide portions.

In the present embodiment in which the actuators 10 and 11 are in contact with the operation shaft 9 after the installing operation of the operation grip 5, the thickness of the operation shaft 9 may be reduced to be smaller than the distance between the actuators 10 and 11 so that the actuators 10 and 11 are not in contact with the operation shaft 9. In this case, however, some rattling may occur.

The above-described embodiment is configured such that, in the installing operation of the operation grip 5, the increased width portion 9*a* is inserted and slidingly moved in the guide grooves 3*c* formed on the upper housing 3, as a device for guiding the operation shaft 9.

Figure 4:
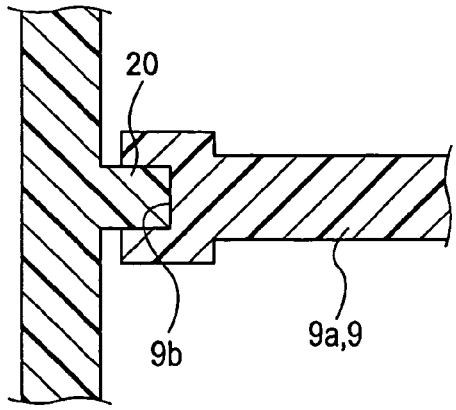
FIG. 4 is a transverse cross-sectional view of relevant parts of a guide device for positioning the operation grip according to another embodiment.

As illustrated in a transverse cross-sectional view of FIG. 4 illustrating relevant parts of the increased width portion 9*a*, the increased width portion 9*a* of the operation shaft 9 may be formed with concave portions 9*b*. Further, guide rails 20 may be formed on the upper housing 3 so that the increased width portion 9*a* is slidingly moved with the concave portions 9*b* being fit in the guide rails 20. The guide portions, such as the guide grooves 3*c* and the guide rails 20, may be formed on an upper extended portion of the chassis portion (e.g., the case 12) of the switch element 2, instead of being formed on the inner walls of the upper housing 3.

The above-described embodiment illustrates, as one example, the switching operation mechanism which drives the switch element 2 by using the oscillatable operation grip 5. The present invention, however, is not limited to the above example. For examplee, the present embodiments can be applied also to a switching operation mechanism in which an operation grip is slidably supported by a housing such that a sliding operation of the operation grip can be performed, a volume control mechanism which changes a resistance value by causing an operation grip to drive a variable resistor (i.e., an electric component), and the like. Accordingly, the assembly work efficiency in installing the operation grip to the housing can be substantially improved.

What is claimed is:

1. An operation mechanism for electric apparatus, the operation mechanism comprising:

actuators;

an electric component that includes a return spring that causes the actuators to automatically return to an initial position;

a circuit board mounted with the electric component;

a housing that covers the circuit board and includes an opening formed at a position that faces the actuators; and an operation grip that includes an operation shaft that is inserted into the opening to be engaged with the actuators and which has an engaging portion at a leading end portion thereof, the operation grip being movably operated with respect to the housing to cause the operation shaft to drive the actuators, wherein a guide portion engageable with and disengageable from the engaging portion is provided to a region on inner walls of the housing or to a chassis portion of the electric component, and wherein, in an assembly process of installing the operation grip to the housing, the operation shaft inserted into the opening is guided into the housing through engagement between the engaging portion and the guide portion, and the engaging portion is separate from the guide portion when the operation shaft has been inserted into the opening by a predetermined length.

2. The operation mechanism for electric apparatus according to claim 1, wherein the guide portion includes a guide groove or a guide rail that extends along a direction in which the operation shaft is inserted.

3. The operation mechanism for electric apparatus according to claim 1, wherein the operation shaft is engaged with the actuators before the engaging portion is separated from the guide portion.

4. The operation mechanism for electric apparatus according to claim 1, wherein the operation grip is rotatably supported by the housing to be oscillatingly operated, and wherein the electric component is a switch element.

5. The operation mechanism for electric apparatus according to claim 1, wherein one pair of the guide portions is formed on opposite regions of the inner walls of the housing.

* * * * *